United States Patent [19]

Sylvester

[11] 3,948,311

[45] Apr. 6, 1976

[54] APPARATUS FOR CASTING METAL SLABS

[75] Inventor: Edmund Q. Sylvester, Shaker Heights, Ohio

[73] Assignee: Massachusetts Institute of Technology, Cambridge, Mass.

[22] Filed: June 13, 1974

[21] Appl. No.: 479,033

[52] U.S. Cl. ..... 164/341; 164/156; 164/342; 249/108; 249/137; 249/167

[51] Int. Cl.[2] ..... B22D 33/02

[58] Field of Search ..... 164/131, 136, 154, 155, 164/156, 335, 339, 341, 342, 343, 348; 249/137, 139, 167, 168, 198, 108

[56] References Cited

UNITED STATES PATENTS

| | | | |
|---|---|---|---|
| 1,250,212 | 12/1917 | Nye, Jr. | 249/139 |
| 1,943,026 | 1/1934 | McCreary et al. | 249/137 |
| 2,290,083 | 7/1942 | Webster | 164/156 |
| 3,411,567 | 11/1968 | Sieger | 164/341 |
| 3,544,058 | 12/1970 | Lohman | 249/82 |
| 3,590,904 | 7/1971 | Woodburn | 164/348 |
| 3,689,023 | 9/1972 | Peck | 249/82 |
| 3,729,049 | 4/1973 | Greenwood et al. | 249/198 |

FOREIGN PATENTS OR APPLICATIONS

| | | | |
|---|---|---|---|
| 735,068 | 8/1955 | United Kingdom | 249/82 |
| 1,962,960 | 6/1971 | Germany | 164/155 |
| 941,447 | 11/1963 | United Kingdom | 164/342 |
| 858,143 | 1/1961 | United Kingdom | 164/342 |

*Primary Examiner*—Francis S. Husar
*Assistant Examiner*—Carl Rowold

[57] ABSTRACT

A method and apparatus for the direct casting of steel slabs for subsequent processing instead of casting ingots and then reducing them to slabs, blooms or billets. A flat elongated casting cavity is formed by an assembly of mold components to define a slab. Prior to casting, this mold is inclined at an angle of about 3° to the horizontal with the bottom end of the casting cavity higher than the pouring end. The molten metal is poured through a sprue attached to the mold assembly adjacent the pouring end. The sprue provides a reservoir for molten metal at a level above the bottom end of the casting cavity so that the casting cavity is completely filled during pouring. When pouring is completed, the mold assembly is promptly tilted to an upright position with the pouring end and sprue at the top. The reservoir of molten metal in the sprue acts as a riser and the sprue is movable so that it follows the shrinking slab and continues to feed molten metal to the casting cavity to compensate for shrinkage during solidification. When the metal solidifies, the mold is disassembled to remove the slab thus cast. The size of the slab can be changed within the limits of the outside mold by moving or changing the thickness of end blocks and side blocks.

9 Claims, 13 Drawing Figures

FIG. 9
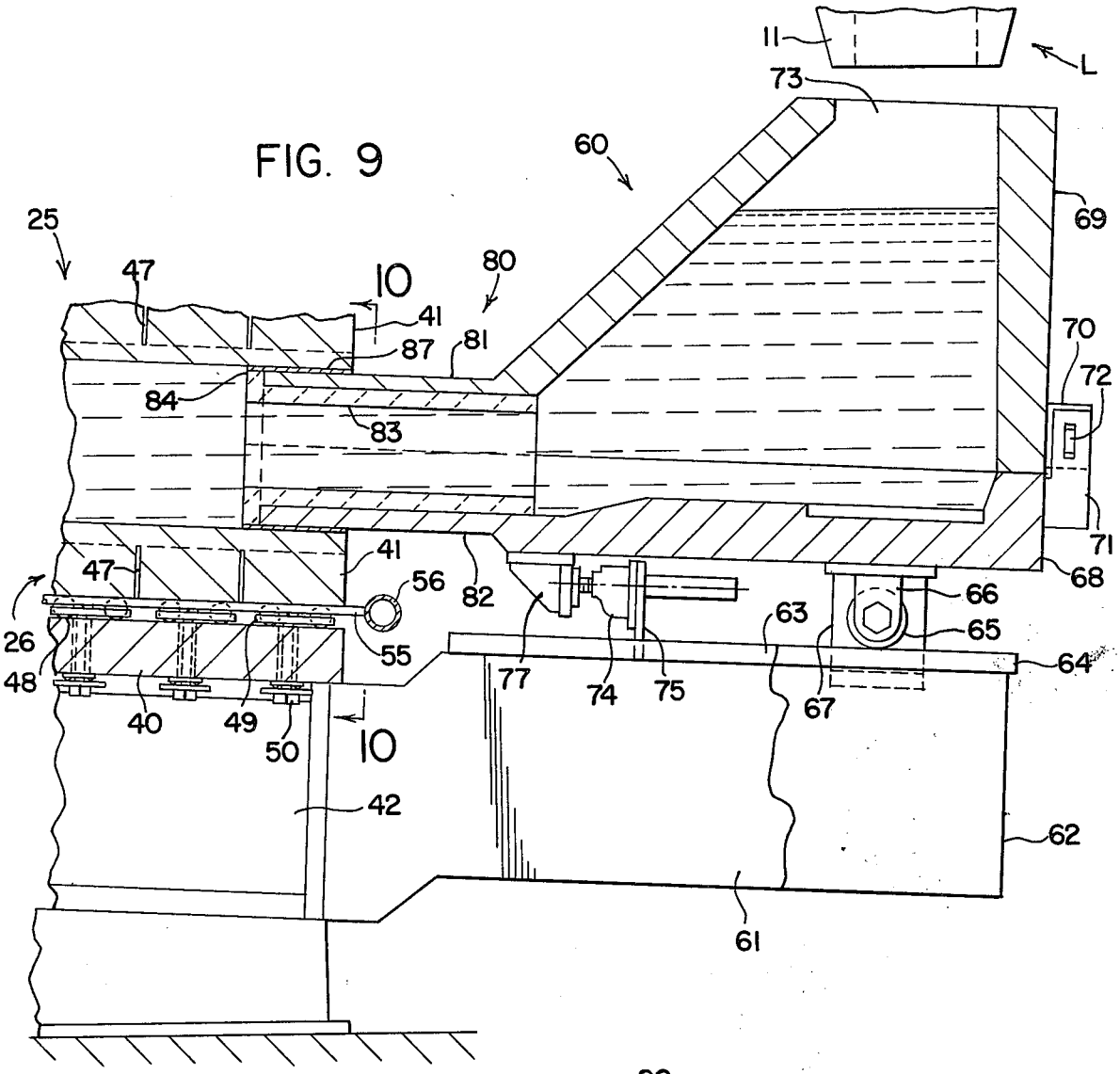
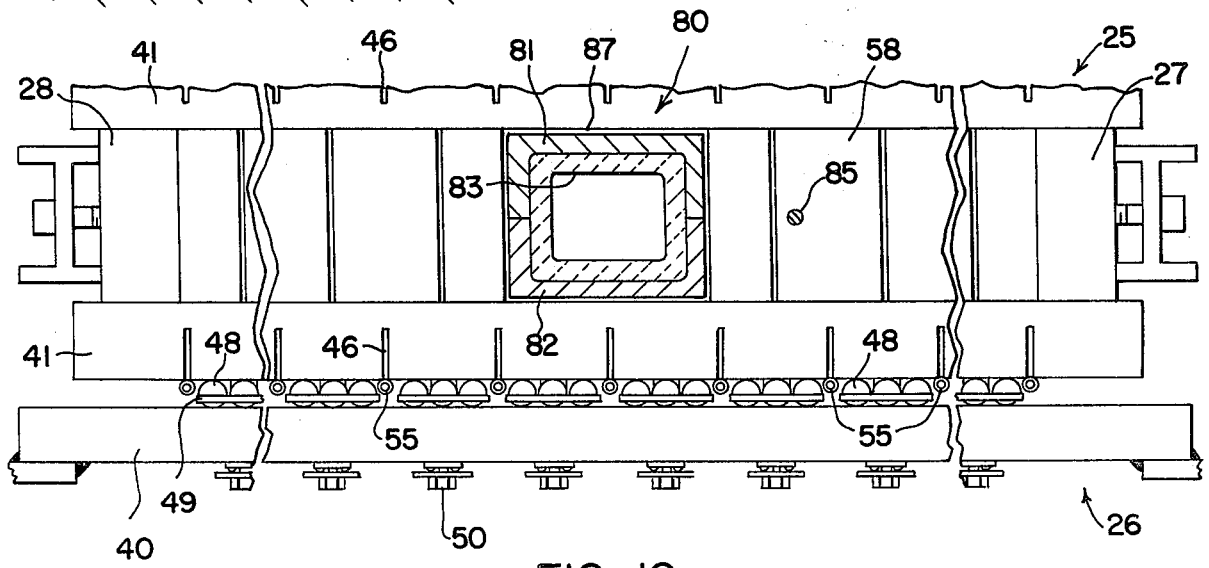
FIG. 10

APPARATUS FOR CASTING METAL SLABS

BACKGROUND OF THE INVENTION

At present time, bar, sheet, strip and other products are obtained from molten steel in several ways. The conventional old-fashioned way is to cast the molten steel into an ingot, roll the ingot down into a slab, bloom or billet and then into bars, sheet, strip or the like as desired. An ingot weighs many tons and is of oblong or square shape, the width being from about 20 inches up to 32 inches and the height around 6 feet or more. A "slab" is a relatively flat, elongated rectangle with a width of from 24 to 80 or more inches, a length of from 10 to 30 feet and a thickness of from 2 to 9 inches. A "bloom" is mostly square in the range of 6 × 6 inches up to 12 × 12 inches and at least 10 feet long. A "billet" is mostly square in the range of 2 × 2 inches up to 15 × 5 inches and at least 10 feet long.

In conventional steel making practice, molten steel is teemed or poured from a ladle into a cast iron ingot mold. The life of an ingot mold varies from 10 to 50 casts depending on the size of the ingot, its shape and temperature of the metal. The major cause of mold rejection is metal thermal fatigue caused by high temperature gradiants between the inside and outside of the mold. With repeated casts, these thermal gradiants cause high tensile stresses to develop in the ingot mold when it cools and they increase to the extent that cracks develop on the inside face. The cracks increase in size and permit penetration of molten metal so that it becomes difficult to strip the ingot from the mold. Ingots in this condition are referred to in the industry as "stickers." When a sticker develops, generally the mold is broken loose and then scrapped. Another reason for mold rejection is erosion of the mold caused by the molten metal stream impinging on the side of the mold as it is poured from the ladle.

Two factors have an important bearing on the quality of steel castings produced according to conventional practices. First, the ingot mold heats up considerably and expands. Secondly, the molten steel in the mold as it starts to solidify shrinks away from the wall of the expanded ingot mold. These two factors combine to cause an air gap to form between the outside of the casting and the hot face of the ingot. The development of the air gap reduces the heat transfer from the ingot to the mold and increases the time necessary for solidification.

After ingots are poured and stripped from the molds, they are placed in a soaking pit to equalize the temperature throughout the ingot prior to rolling. The ingot may stay in the soaking pit as long as 24 hours, all of which requires a large volume of soaking pit gas to maintain a uniform temperature. After soaking, the ingot is usually rolled on a mill to form slabs, blooms or billets and the power required to reduce the ingot to these forms is considerable.

It will be apparent from the above description that considerable time and expense is involved in the steps of teeming ingots, stripping the molds from the ingots, equalizing the temperature of the ingots in the soaking pit, and subsequent rolling of the ingots to form blooms, slabs and billets. Accordingly, attention has been devoted to developing techniques for casting refined molten steel directly into slabs in order to avoid the time-consuming and expensive steps described above.

A more modern technique for making slabs, blooms and billets is the continuous casting process whereby molten steel is poured into a tundish, from there into vertical molds and then withdrawn by rolls or other mechanism. Lengths are cut off to give slabs, blooms or billets. While this technique is deceptively simple in practice, in principle it presents many inherent difficulties and the capital investment is very large.

Another technique is the bottom pressure casting method as described in my U.S. Pat. No. 3,196,503. According to the bottom pressure casting method, a ladle filled with molten steel is placed in a pressure vessel which is sealed with a lid. A pouring tube extends through the lid down to approximately 2 inches from the bottom of the ladle. The top part of the pouring tube is mechanically engaged to the filling end of the slab casting mold. Air pressure within the vessel causes the molten steel to rise through the pouring tube and enter the mold which is located at a slight tilt so that the molten metal enters the lower end. Usually a riser is provided on the mold. The mold is then supported in the relatively flat position until the molten metal solidifies to form a cast slab. The shrinkage of the metal quickly causes a gap to occur between the top surface of the molten metal and the wall of the mold. Since the hot metal goes to the top, inclusions and dirt tend to float to the top and this results in a defective surface on the top of the slab. When these slabs are rolled, the top surface of the rolled product is unsatisfactory and it is often necessary to burn off the top portion.

The apparatus of the present invention reduces the difficulties described above and afford other features and advantages heretofore not obtainable.

It is among the objects of the invention to cast refined ferrous metal directly into slabs with lower production costs, at higher production rates in a manner that maximizes the yield from the molten metal being poured, minimizes losses, and produces slabs with improved surface quality.

SUMMARY OF THE INVENTION

In accordance with the present invention, a mold is provided which defines an elongated slab casting cavity with a pouring end and a bottom end in a position with the pouring end below the bottom end and the cavity inclined at an angle of about 3° to the horizontal. The molten metal is poured into the pouring end through a sprue attached to the mold with metal retaining capacity of a level above the bottom end so that the slab casting cavity is completely filled. Then the mold together with the sprue are tilted to a generally vertical position with the pouring end and sprue at the top so that sprue serves as a riser and the molten metal within the sprue feeds into the cavity gradually to compensate for shrinkage of the metal during solidification. The mold may be cooled by an integral cooling system to achieve a faster solidification and a more uniform temperature throughout the casting. The mold components should be readily disassembled after the casting solidifies so as to facilitate its removal.

A mechanism is provided for pivoting the mold from its initial pouring position to the vertical and back to the substantially horizontal pouring position.

BRIEF DESCRIPTION OF THE DRAWINGS

FIG. 9 is a sectional view illustrating an alternate form of sprue and riser assembly for use with the slab casting mold of FIGS. 1 and 8;

FIG. 10 is a fragmentary sectional view taken on the line 10—10 of FIG. 9;

DESCRIPTION OF THE PREFERRED EMBODIMENT

Figure 1:
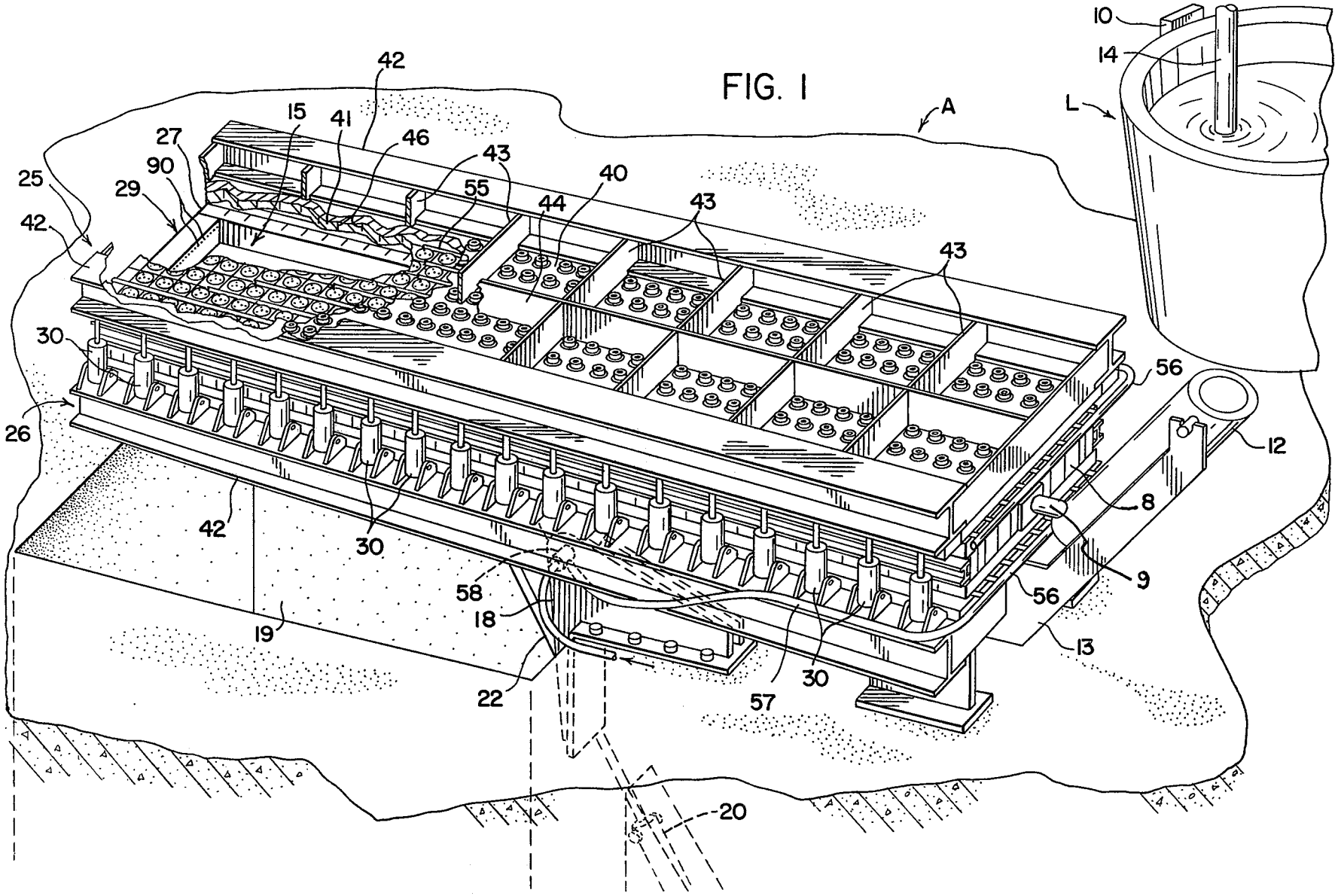
FIG. 1 is a perspective view with parts broken away illustrating a pivotal mold assembly for casting slabs and a teeming ladle positioned for filling the mold, the pivotable mold being shown in its initial pouring or teeming position and pivoting counterclockwise.

Referring more particularly to the drawings and initially to FIGS. 1 through 7, there is shown a mold assembly A for casting molten steel into slabs in accordance with the invention. The mold assembly is shown in its initial inclined pouring position in solid lines in FIGS. 1, 2 and 3 and in its upright position in dashed lines in FIG. 2. The procedures involving the use of the two positions will be described in more detail below. As viewed in FIGS. 1, 2 and 3, the mold assembly A is positioned for teeming from a teeming ladle B supported by crane hooks 10 from an overhead crane (not shown) and having its tapping spout 11 (FIG. 2) positioned immediately above a sprue or filling trough 12 supported on bracket arms 13 attached to the pouring end or right-hand end of the mold assembly A as viewed in FIGS. 1 and 2. When the ladle stopper 14 is lifted, molten metal in the teeming ladle B will pour through the sprue or filling trough 12 into the casting cavity 15 within the mold assembly A.

It will be noted that the mold assembly A is inclined at an angle of about 3° with the horizontal so that the left-hand or bottom end thereof is located above the pouring end or right-hand end. The sprue or filling trough 12, however, is arranged at an upwardly inclined angle of about 45° with the mold assembly A so that the level of the reservoir molten metal therein will generally be above the level at the bottom end of the mold assembly A and complete filling of the casting cavity 15 can be accomplished.

Figure 2:
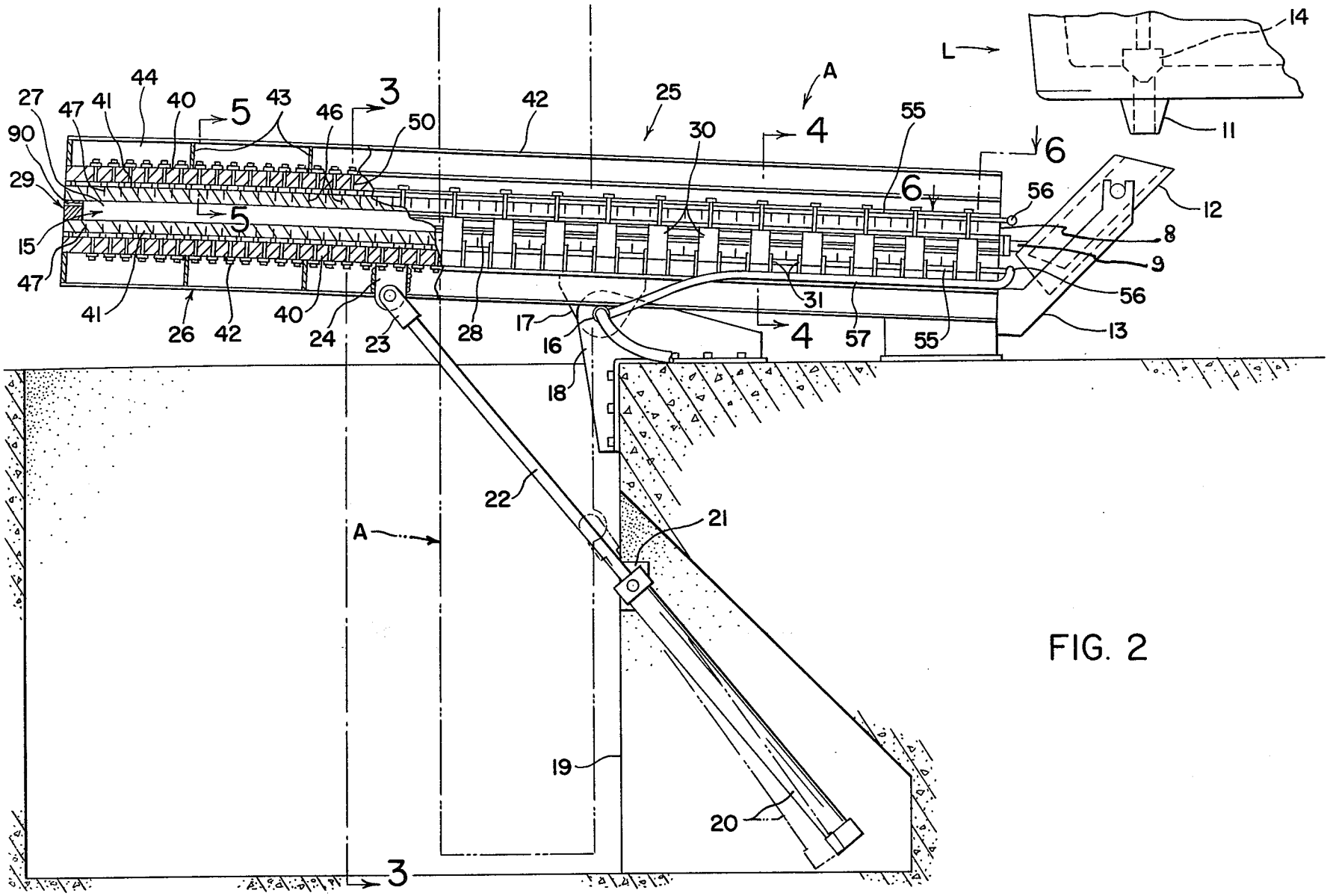
FIG. 2 is an elevational view of slab casting mold of FIG. 1 with parts broken away and shown in section for the purpose of illustration and with the mold assembly shown in its initial pouring position in solid lines and in its upright position in dashed lines.

As viewed in FIGS. 1 and 2, the mold assembly A rests at its forward or upper end on a pair of spaced feet and is supported intermediate its ends by pivot pins 16 that serve to connect hinge brackets 17 welded to the mold assembly A to hinge brackets 18 connected to the edge of a deep recess or pit 19 into which the bottom end of the mold assembly may be lowered by pivotal movement to the position shown in dashed lines in FIG. 2.

Figure 3:
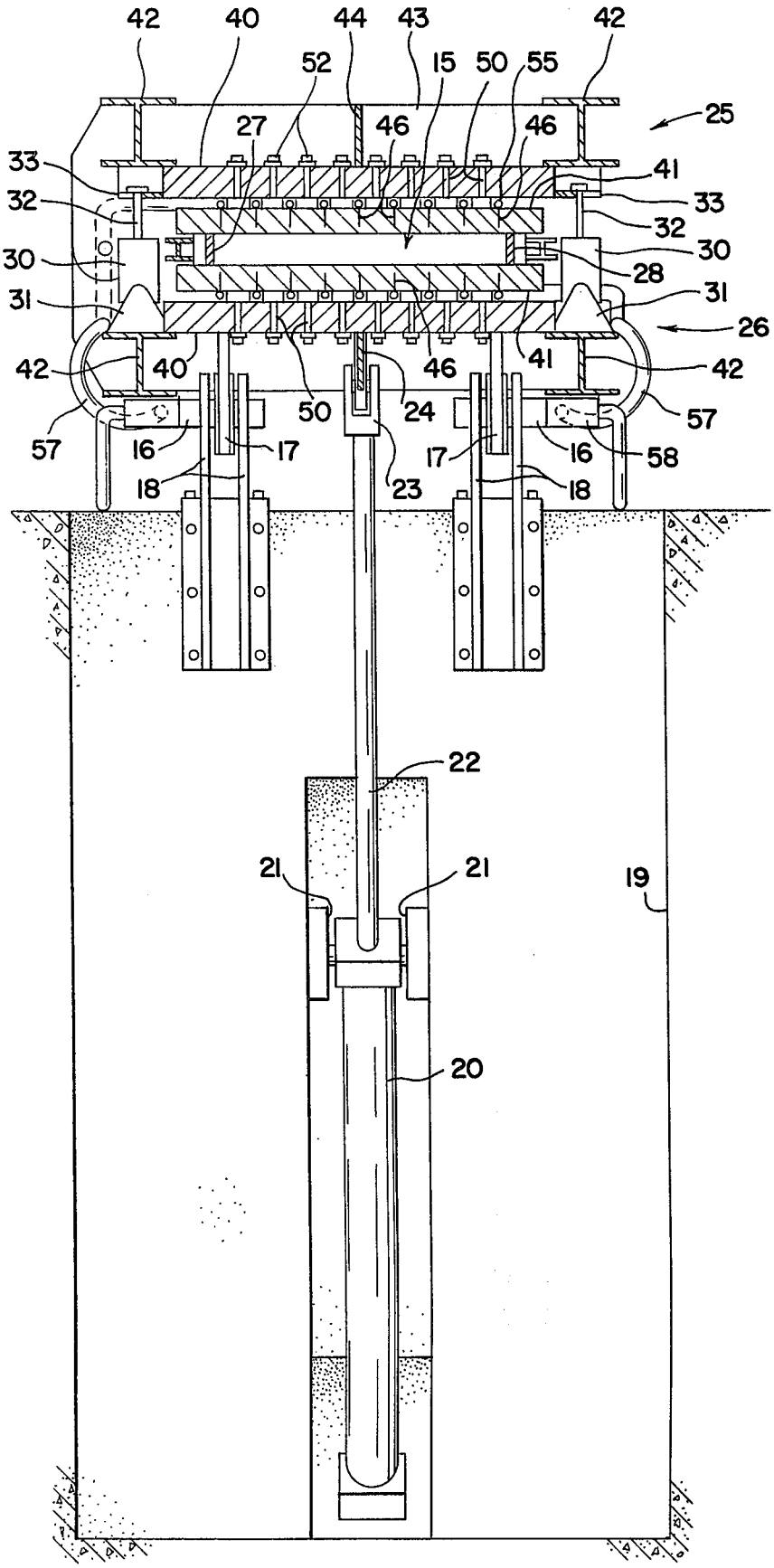
FIG. 3 is a sectional view taken on the line 3–3 of FIG. 2.
Figure 4:
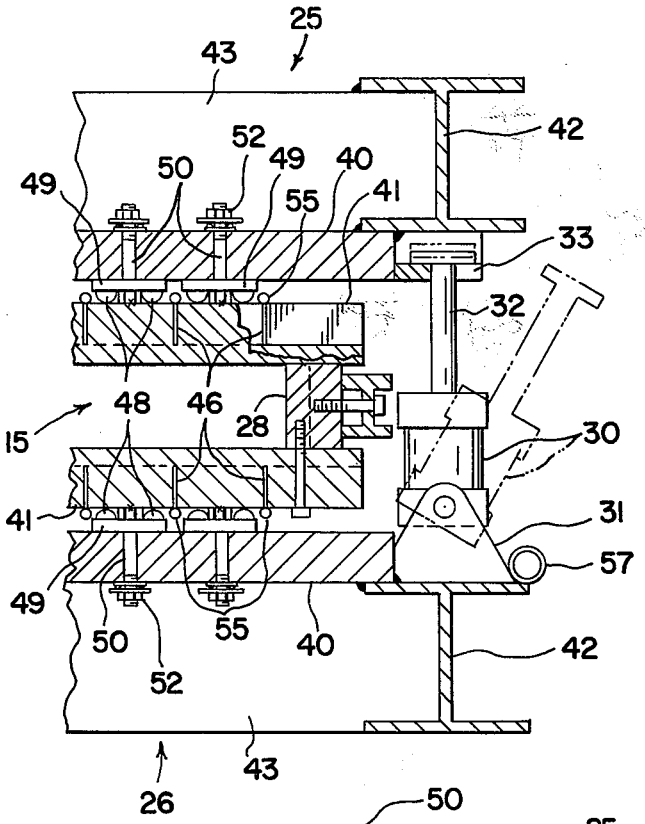
FIG. 4 is a fragmentary sectional view on an enlarged scale taken on the line 4—4 of FIG. 2.

The mold assembly A is pivoted between the respective positions by means of a hydraulic cylinder 20 pivotally connected to brackets 21 (FIGS. 2 and 3). The piston rod 22 associated with the cylinder 20 has a clevis end 23 pinned to a bracket 24 welded to the mold assembly A.

The mold assembly A comprises mold sections which define the slab casting cavity 15 and which include, as principal elements, an upper mold section 25 and a lower mold section 26 which define the faces of the slab to be cast. The sections 25 and 26 are hinged to one another and spaced apart by longitudinal mold side sections 27 and 28 that extend the length of the casting cavity and which define the longitudinal side edges of the slab. The bottom end of the slab is defined by a bottom block 29 and the top or pouring end by top block 8. Bottom block 29 is provided with a plurality of small vent holes 90 adjacent the upper edge thereof in the pouring position (FIG. 1). These vent holes are preferably about 3/16 inch in diameter. Other vent means may be used as desired such as the V-shaped vents in the top face of block 29. Care must be taken to avoid a vent means which interferes with removal of the slab from the mold and that is why I prefer the relatively small vent holes 90.

The upper and lower mold sections 25 and 26 are clamped together securely to define the mold cavity 15 by a plurality of clamping clyinders 30 pivotally connected to brackets on the lower mold section 26 and having their piston rods 32 adapted to be anchored in slots in the upper mold section 25 in a manner to be described in more detail below. In the embodiment shown, the cylinders 30 are located on 18-inch centers along the sides of the mold sections 25 and 26.

The mold is oriented so that the width of the slab being cast or mold cavity 15 is substantially horizontal. This facilitates pouring, venting and filling the mold cavity. I suppose that it might be possible to cast the slab on its edge so that the width was vertical, but this presents unnecessary complications and is not desirable. The axis running through the center of the slab lengthwise is the major axis and the axis running through the center widthwise is the minor axis. In other words, the minor axis of the slab cavity of the mold should be substantially horizontal when it is initially being filled with molten ferrous metal.

The constructions of the sections 25 and 26 are similar in most respects and, therefore, will be described only with respect to the upper mold section 25, like numerals being used to identify like parts in the lower mold section 26.

The sections 25 and 26 each have as primary member a backing plate 40 formed of low carbon steel and having a relatively flat rectangular form, and a liner plate 41 of rectangular form spaced from the backing plate 40 about an inch. The inner surface of the liner plate 41 defines the surface of the slab casting cavity.

Figure 6:
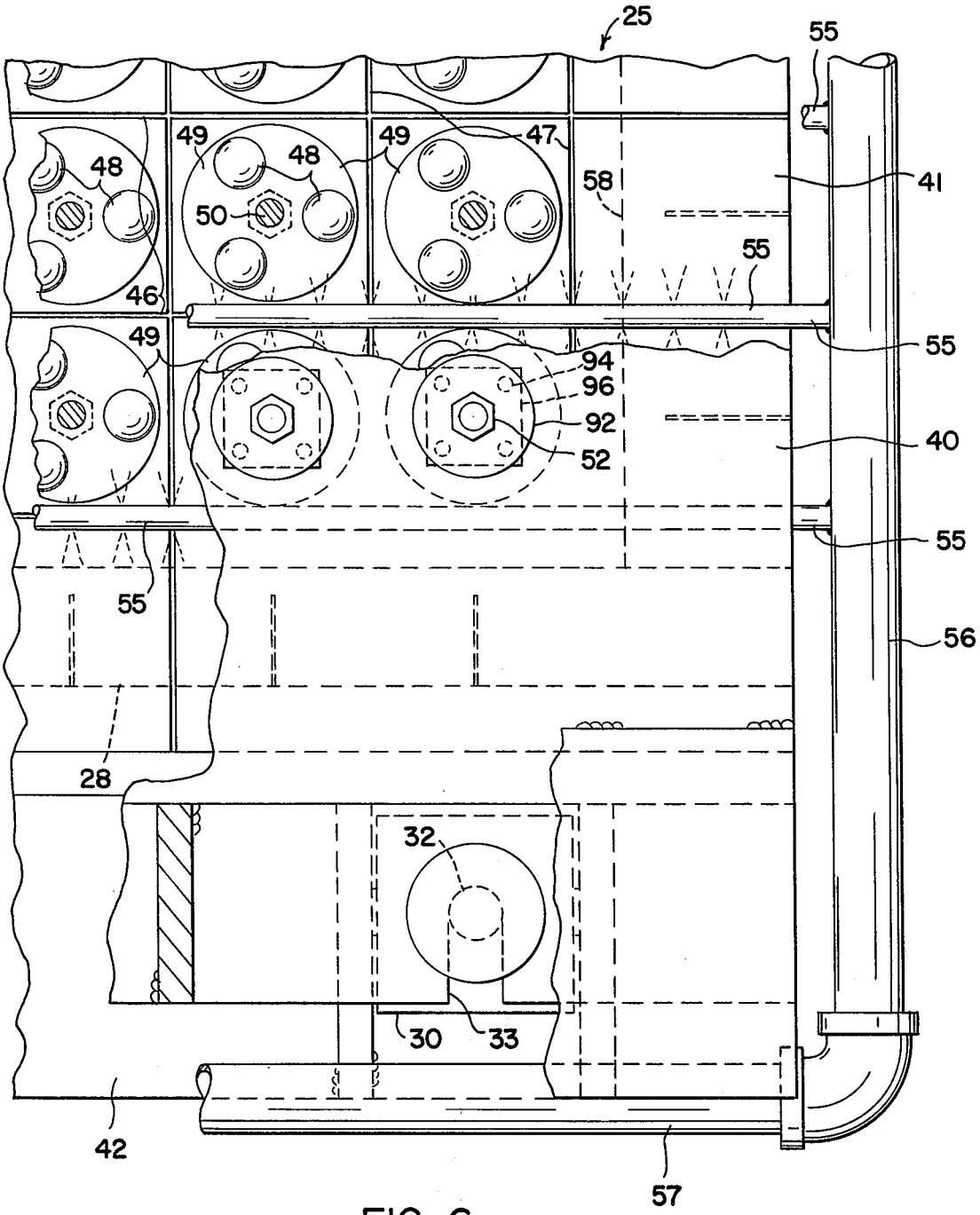
FIG. 6 is a fragmentary plan view on an enlarged scale with parts broken away illustrating a portion of the mold of FIG. 1 taken from the line 6—6 of FIG. 2.

The backing plate 40 is supported and braced by a rectangular frame including longitudinal eye beams 42 extending along each side of the mold assembly, cross braces 43 in the form of steel plates located about every 3 feet along the length of the mold and center inner plates 44 extending along the central portion of the mold between the cross braces 43. The liner plate 41 is approximately 4 inches thick and has a matrix of slots formed therein extending about 3 inches deep (FIG. 6). The slots include parallel longitudinal slots 46 and parallel lateral slots 47, all spaced to define 6-inch squares throughout the top face of the liner plate 41. The slots each have a width of from 1/16 inch to 3/16 inch (or possibly up to ¼ inch) and are adapted to permit water cooling and expansion and contraction of the liner plate 41 in length and width without any resulting buckling or warping of the plate. This prevents any variations in the configuration of the slab casting cavity 15. The interior face of the liner plate 41 is coated with $Al_2O_3$ or $SiO_2$ according to practices well known in the art. The grade of steel for the linear plate is selected to provide advantageous ductility and strength, low carbon steel being preferred, such as, from 1010 to about 1020.

Figure 5:
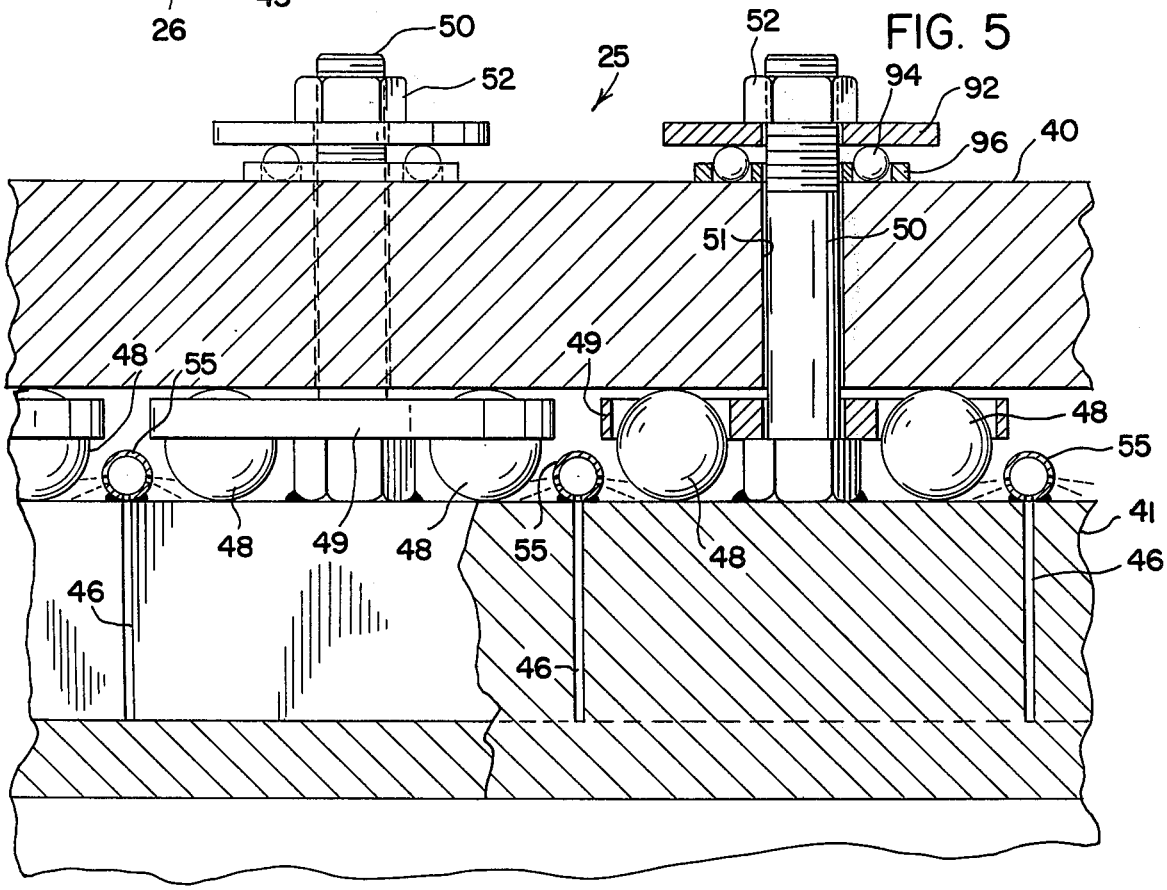
FIG. 5 is a fragmentary sectional view on a still larger scale taken on the line 5—5 of FIG. 2.

The backing plate 40 and liner plate 41 are spaced from one another by a pair of steel ball bearings as shown in FIG. 5, the larger ball bearings being part 48 about 1 inch diameter and being retained in triangular ball bearing seats 49. The backing plate 40 and liner plate 41 are clamped together by machine bolts or Nelson studs 50 that have their heads welded to the outer surface of the liner plate 41. The bolts 50 are spaced approximately 6 inches apart and are centered in each of the squares defined by the slots 46 and 47 (FIG. 6). The bolts extend through slots 51 (FIG. 5) formed in the backing plate 40, the slots 51 being adapted to permit expansion and contraction of the liner plate 41 relative to the backing plate 40. The bolts 50 are secured to the backing plate 40 by nuts 52. The bolts 50 extend through the bearing retainers 49, each of which is adapted to receive three of the ball bearings 48. On the opposite side of the backing plate 40 are small ball bearings or rollers 94 contained by bearing seat 96 and pressure plate 92.

The ball bearings 48 and 94 serve to accommodate relative movement between the backing plate 40 and liner plate 41, which movement results from the extreme heat and temperature differentials which exist between the various parts of the mold during various stages of the casting operation. Having ball bearings on both sides of the backing plate thus provides adequate means to accommodate relative movement between the backing plate and liner plate without inducing excessive stresses in the system.

The slots 46 and 47 also function to facilitate cooling of the mold during the casting operation. According to the preferred embodiment of the invention, the water cooling system (FIG. 7) comprises a plurality of water tubes 55 that extend across each of the longitudinal slots 46 (FIGS. 5 and 6). The tubes 55 are welded in place over the slots and have small openings or ports that permit cooling water to be sprayed into the respective slots 47. The water tubes 55 are connected to a header pipe 56 (FIG. 6) that extends across the pouring end of each of the mold sections 25 and 26 and connects to a main supply pipe 57. The water that is sprayed out during the casting process is converted to steam to some extent and the remainder drops to the floor where it drains off. The main supply pipe 57 extends to the pivot at the pivot pin 16 and connects to a rotary joint 58 through which the water is distributed in either of the operating positions of the mold assembly as well as the during the pivoting of the mold assembly between its respective positions.

Figures 7, 8:
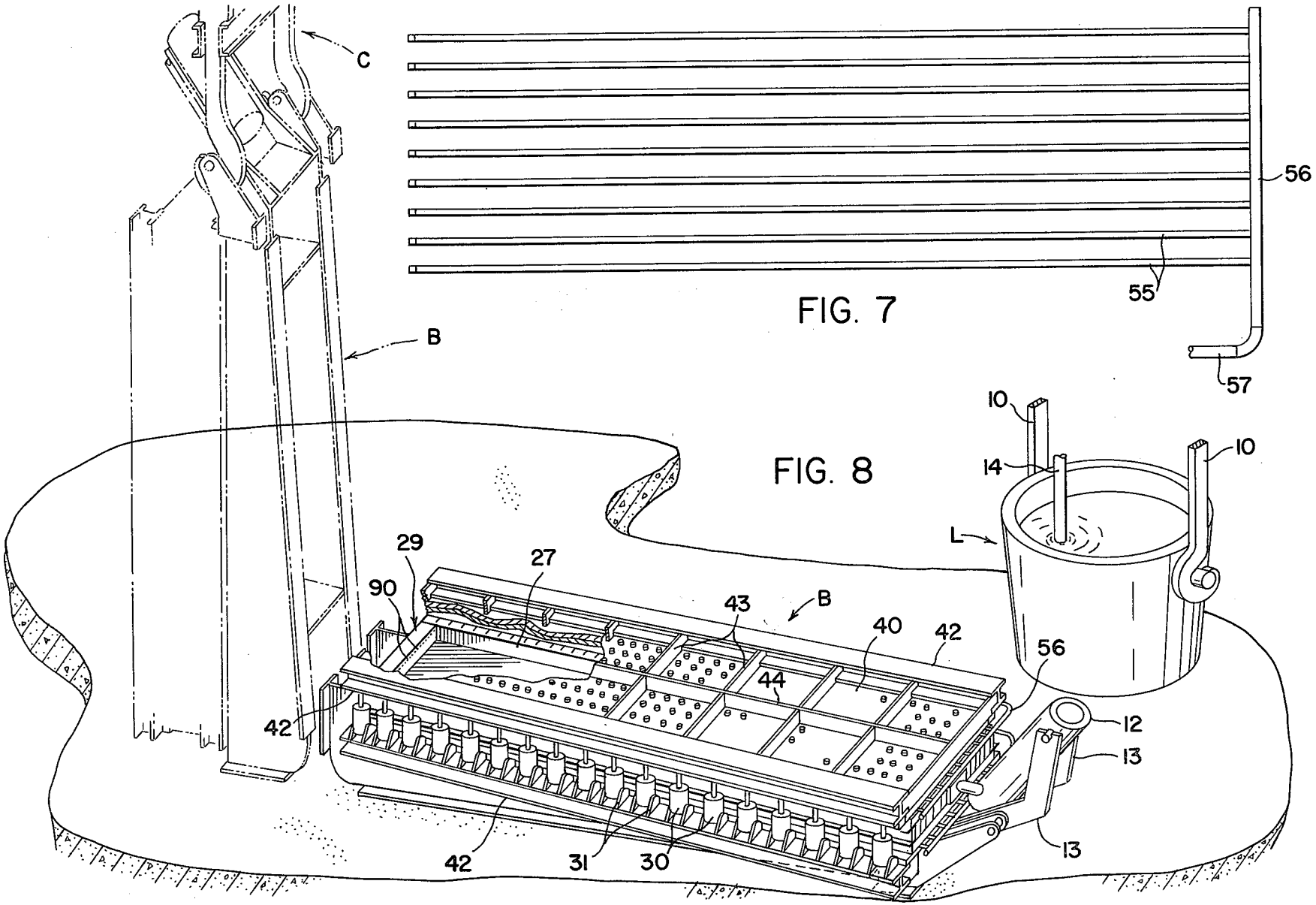
FIG. 7 is a schematic diagram illustrating the arrangement of cooling water lines for the mold of FIG. 1.
FIG. 8 is a perspective view illustrating an alternate form of pivotal slab casting mold embodying the invention, the mold being shown in its initial teeming position in solid lines and in its upright tilted position in dashed lines.

FIG. 8 illustrates a modified form of the invention wherein a mold assembly B which is essentially identical in most respects to the mold assembly A is movable between its reclining position and its upright position by means of a crane C that merely lifts the pouring end upward swinging the mold about its base. This modified arrangement is adapted for circumstances where the space and steel handling facilities do not permit the use of the downward pivoting type mold. The construction of the mold B is essentially identical to the construction of the mold A and will not be further discussed herein.

In the operation of both the mold A of FIGS. 1 through 7 and the mold B of FIG. 8, the mold assembly is first prepared by positioning the clamps with their piston rods in the respective slots, actuating the cylinders 30 to tightly clamp the mold sections 25 and 26 to define the mold cavity 15. In this position the molding cavity is inclined at an angle of about 3° to the horizontal with the bottom end of the mold at a level above the pouring end. Just before pouring, the mold is purged of oxygen by filling it with an inert gas, such as argon, and permitting some of the argon to escape through the small vent holes 90 in the bottom block 29. To begin the operation, the teeming ladle L is carried by an overhead crane to a position with its tapping spout 11 located over the filling trough 12. The stopper 14 is then released and molten metal is poured from the ladle L into the filling trough 12 from which it flows through the ceramic sprue 9 in top block 8 and into the mold cavity. As pouring continues, the molten metal fills the cavity and the inert gas that has initially been used to purge the molding cavity 15 escapes through the vent holes 90. Since the level of molten metal in the filling trough 12 rises to a level above the bottom end of the slab casting cavity 15, the molten metal will completely fill the cavity and will extend slightly into the vents 90 in the bottom member 29 and freeze therein to completely seal the bottom of the cavity.

The purpose of the initial inclination of the mold from the horizontal of approximately 30° is to control the rush of molten metal to the bottom end of the slab casting cavity. If the mold were horizontal, it would subject the bottom end to severe shock forces. As the angle increases, the height of the bottom end increases and the height of the sprue has to increase. I have found that 3° is a good working angle. The angle could be as low as 1½° or 2° and as high as 10° but 3°–5° is the preferred range.

Promptly after the mold is filled, the circulation of cooling water is commenced and almost simultaneously therewith the cylinder 20 (or crane C of FIG. 7) is actuated to pivot the mold assembly A (or B) about the axis of its pivot pins 16 to an upright position illustrated in dashed lines in FIGS. 1 and 2. In this position, the reservoir of molten metal in the sprue or filling trough 12 serves as a riser to continuously feed molten metal to the casting cavity 15 as solidification and resulting shrinkage of the molten metal continues. The pivoting operation usually takes about 20 seconds and should be accomplished at least within one minute after the pouring operation is completed.

The mold A or B should be pivoted approximately 90° to the vertical. Pivoting to anything other than the vertical, within say plus or minus 15°, I believe, will operate with the concepts of my invention but may induce complications of balance, continued supply of molten metal and cause an undesirable slanted top end on the slab when it solidifies.

As the metal shrinks, it will pull away from top block 8 and probably break the ceramic tile or sprue 9. For this reason, the sprue 9 must be replaced after each casting.

An obvious alternative to molds A and B as shown is to provide a platform or frame which pivots in the same manner and which is adapted to receive a mold set upon it. In other words, I also contemplate an arrangement wherein a slotted mold of the present invention is set up on a platform, purged, filled with molten steel, and then the platform and mold together are pivoted to the vertical.

The present invention has application to the manufacture of slabs of ferrous metals such as steel and stainless steel.

A complication of the process of the present invention is the fact that the metal shrinks substantially as it cools and can shrink downward so as to break off the sprue and prevent the necessary supply of molten metal. To overcome this complication, the sprue should be made to move downward with the metal and provide a continuous supply of molten metal. Alternatively, the top block can be made to move along with the sprue, the latter solution, I suspect, being less desirable than the former.

The sprue and riser illustrated in FIGS. 9 to 14 is a modification adapted for use in connection with the slab mold assemblies of either FIGS. 1 or 8 and is intended to provide a means for permitting downward movement of the sprue as the molten metal solidifies. In this case, a movable riser assembly 60 is provided instead of the filling trough 12 of both FIGS. 1 and 8. The riser assembly 60 is supported by a pair of brackets 61 and 62 connected to the bottom I beam 42. A pair of parallel rails 63 and 64 are welded to the top of the brackets 61 and 62 respectively and provide ways for wheels 65 carried in wheel forks 66 on the movable riser assembly 60. Adjacent each of the wheels 65 is a retainer bracket 67 welded to the riser assembly 60 and having an arm portion that extends underneath the respective rail 63, 64 to retain the riser assembly 60 in position when the mold is pivoted to the vertical position.

Figure 12:
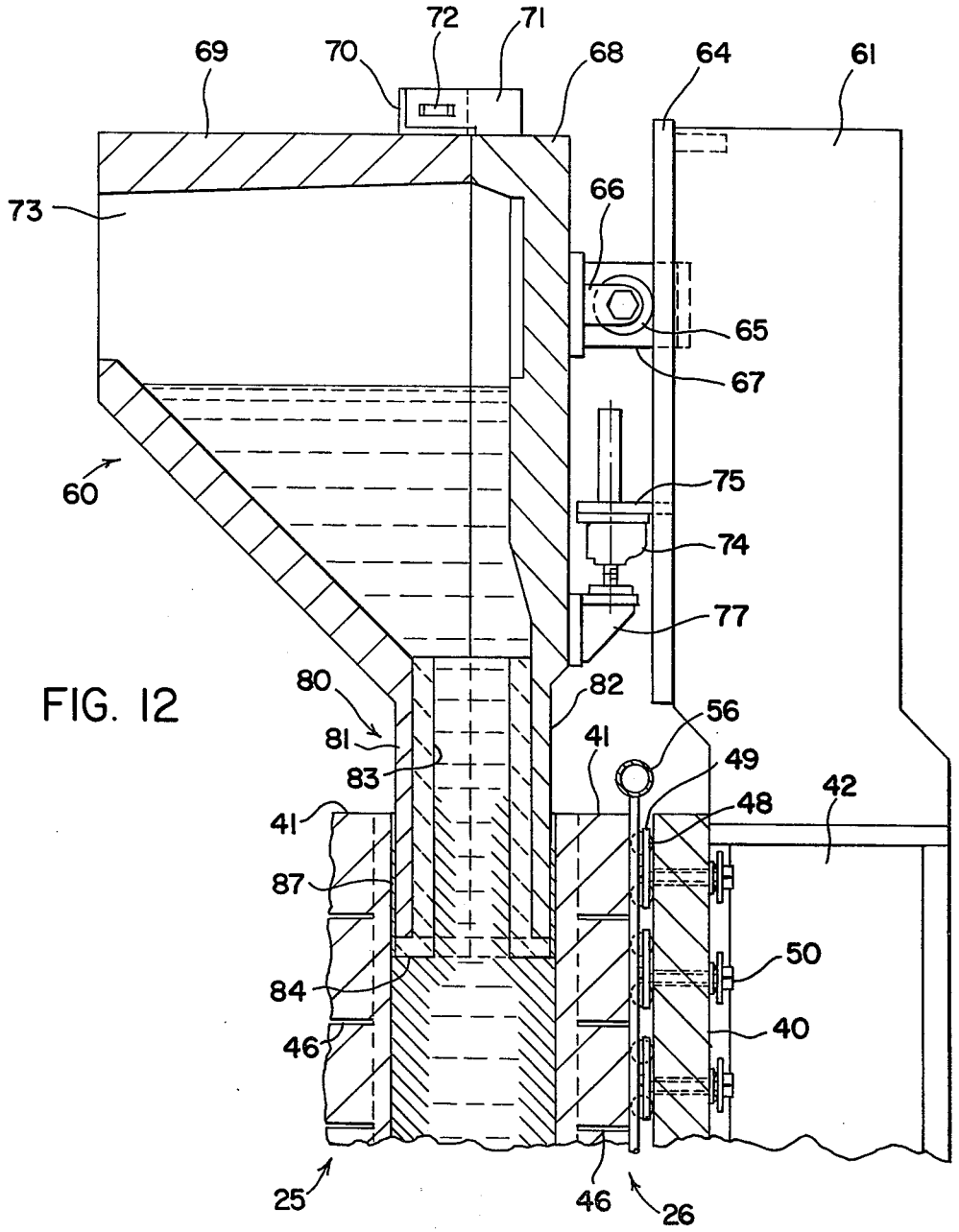
FIG. 12 is a sectional view similar to FIG. 9 illustrating the condition of the sprue and riser assembly with the mold in the vertical position.

The assembly 60 includes a base block 68 and a wall section 69 resting thereon. The wall section 69 is clamped to the base block 60 at three locations (two on each side and one at the rear) by means of a clevis 70 on the wall section with holes extending therethrough aligned with matching holes on a tongue 71 on a base block 68. A retainer pin 72 passes through the respective openings as best illustrated in FIG. 12. The base block 68 and wall sections 69 define a reservoir 73 for the molten metal.

The riser assembly 60 is adapted for reciprocating travel toward and away from the filling end of the mold, the wheels 65 riding on the rails 63 and 64. The motive force is provided by two screw jacks 74 mounted on brackets 75 connected to the respective rails 63 and 64. Each screw jack 74 is driven by an electric motor 76 controlled by a slab shrinkage sensing mechanism to be described in detail below. The threaded members of the screw jacks 74 are connected at their forward ends to brackets 77 and 78 connected to the riser assembly 60.

Extending from the forward end of the movable riser assembly 60 is a rectangular sprue assembly 80. The sprue assembly 80 includes a cast iron outer tubular portion having an upper part 81 and a lower part 82 integral with the base 68 and wall 69 respectively of the movable riser assembly 60 and which extends into the forward end of the mold approximately the depth of the end member 58. Within the tubular portion 81 is a ceramic liner sleeve 83 with a radial flange 84 on its inner edge. The ceramic sleeve 83 is adapted for sliding movement relative to the surrounding tubular portions 81, 82 as will be described below.

In order to permit relative movement between the shrinkage compensating riser and the top block 8, a seal or gasket of asbestos 87 is provided around the cast iron outer tube. Other suitable materials may be used such as Fibro-Frax and Dyna-Flex, which are refractory felt-like pads manufactured by Babcock & Wilcox and Johns-Manville. Both the ceramic sleeve 83 and the asbestos seal 87 should be replaced after each casting.

When the mold is pivoted to its upright position as illustrated sequentially in FIG. 12, the molten metal in the reservoir 73 flows to the condition illustrated and continues to feed molten metal to the mold cavity during the solidification process. As indicated above, it is desirable that the molten metal be fed into the slab during shrinkage at the end of the slab even though it is spaced from the upper end of the mold cavity and to accomplish this, the movable riser assembly 60 is moved forward or downward so that the sprue assembly 80 and ceramic sleeve 83 is extended into the mold cavity. This motion is provided by the screw jacks 74.

Figure 11:
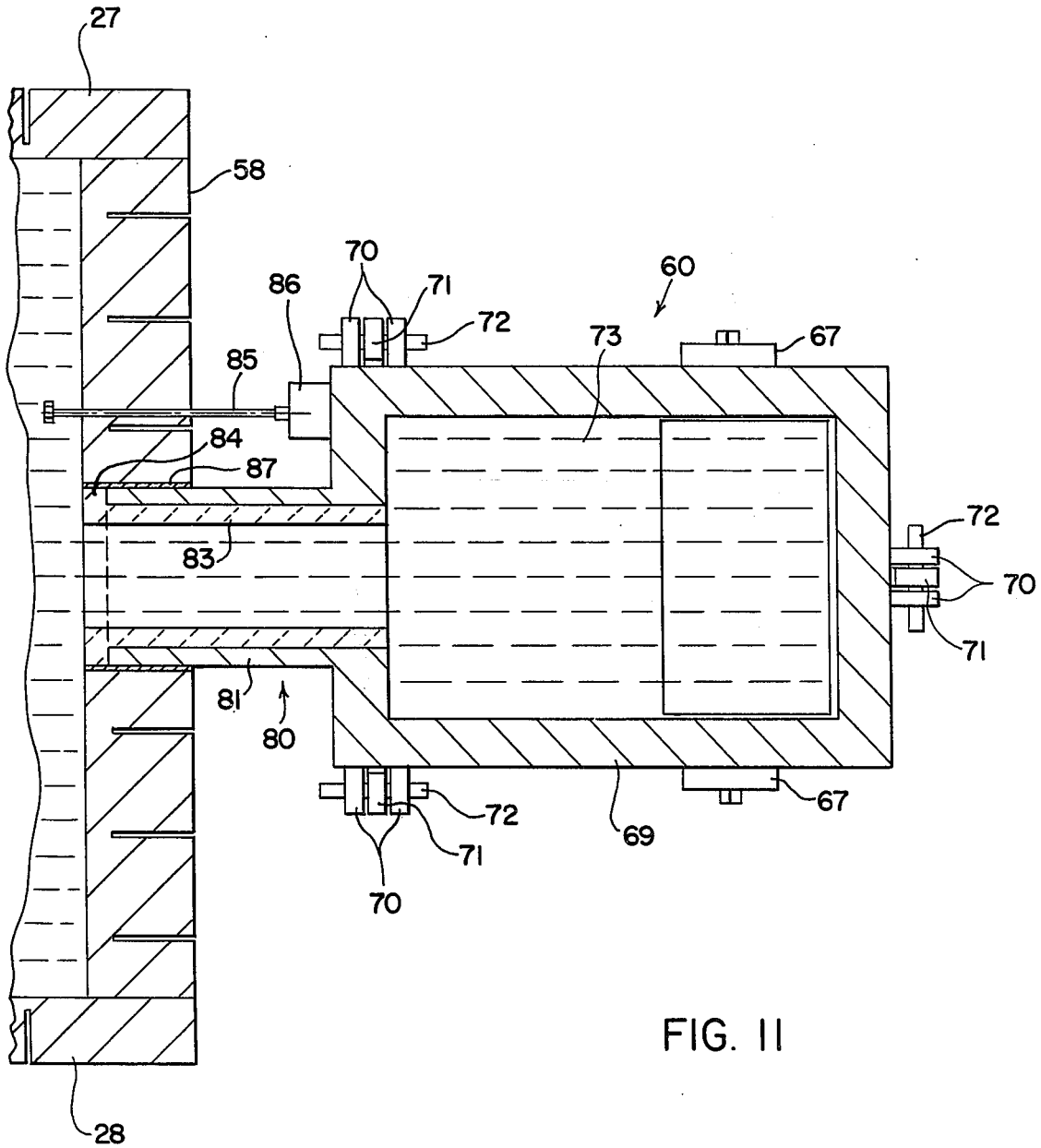
FIG. 11 is a horizontal section taken on the line 11—11 of FIG. 9.

The control of the motors 76 for the screw jacks 74 is accomplished by means of a shrinkage sensing device comprising an elongated sensor rod 85, best illustrated in FIG. 11, which extends through a bore in the mold end member 58. The forward end of the rod 85 is initially embedded in the molten metal, and as shrinkage occurs, is pulled downwardly (FIGS. 12 and 13) with the upper end of the slab. The outside end of the rod 85 is connected to a microswitch unit 86.

When the mold is filled with steel, the molten metal surrounds and fuses to the rod 85 so that when the mold is filled and pivoted to its vertical position (FIGS. 12 and 13), the rod is pulled downward as the slab shrinks to actuate the microswitch which in turn energizes the motors 76 of the screw jacks 74. This causes the riser assembly 60 to be moved downward to compensate for slab shrinkage.

Figure 13:
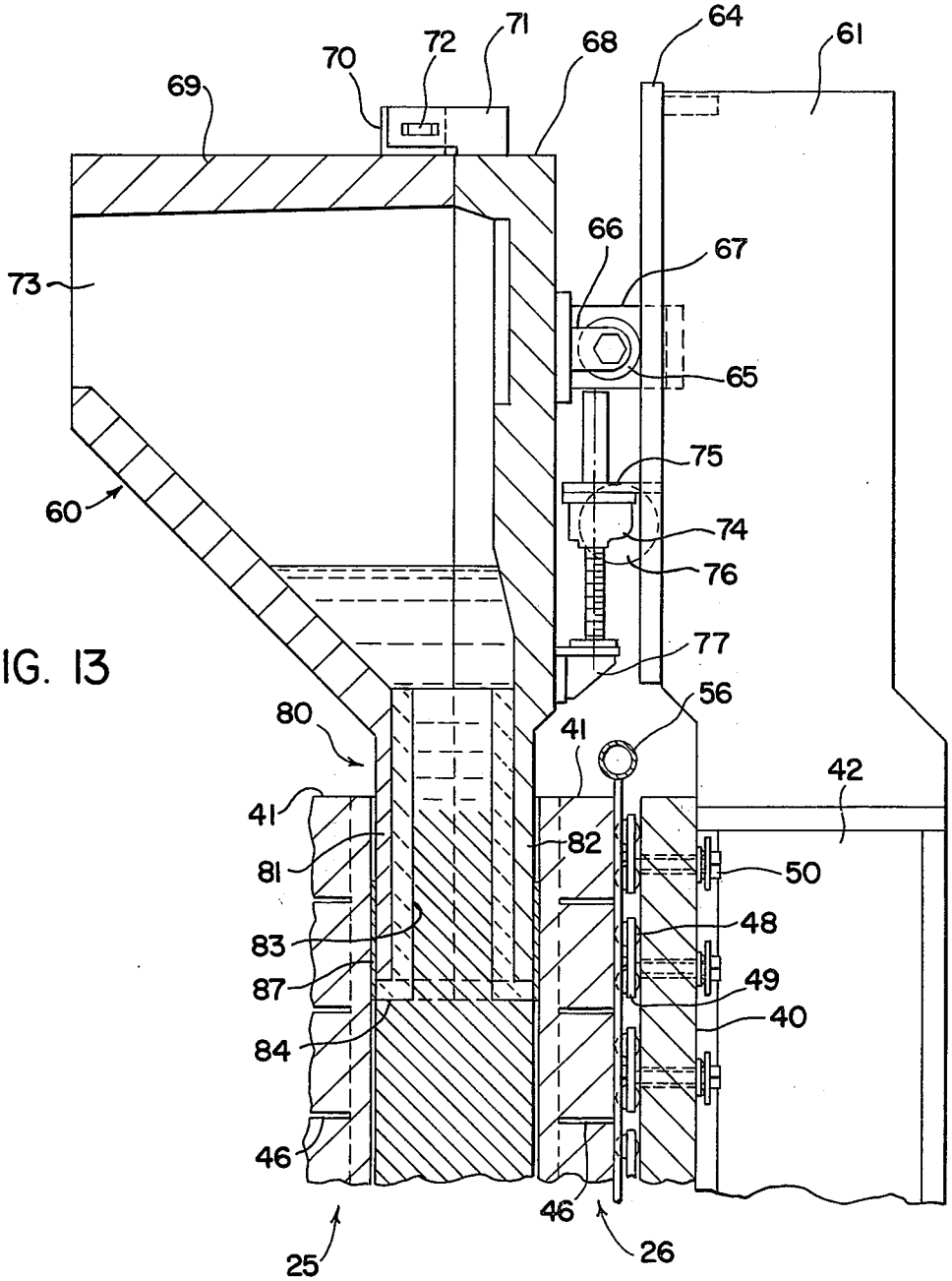
FIG. 13 is a sectional view similar to FIG. 12 illustrating the condition of the sprue and riser assembly after the slab has solidified.

When the metal has solidified, the movable riser assembly 60 and sprue assembly 80 will have moved forward to the condition shown in dashed lines in FIG. 13. This represents the forward most movement of the riser assembly 60 and essentially all the shrinkage of the slab has been compensated for. Generally, the shrinkage would amount to about 5 inches at the top of the mold. This arrangement greatly improves the yield and results in more sound castings.

In the practice of the invention described above, it is hoped that the yield in percentage of molten steel utiilized in the slab will be between 95 and 96%. This compares favorably with a figure of about 80% under the very best conditions obtainable from the prior art.

A particular advantage of the apparatus and method described above is that of an improved surface quality of the resulting slab. Dirt and other inclusions should float to the top of the slab rather than to one of the surfaces as they did in the prior art systems where the slab was permitted to solidify in a flat position. In the resulting casting herein, the inclusions are all in the top 2 to 3 inches of the slab, and can easily be burned off. Another advantage deriving from the invention is that any buckling of the mold plates is eliminated by the use of the slots 46 and 47. In prior art practice the face of the cast slab would often be distorted due to buckling in and/or buckling out of the mold plate. The slots eliminate that condition. Also, the use of the two-part mold, including the liner plate 41 and backing plate 40, prevents the face from distorting due to hydrostatic pressure when the mold is pivoted to the vertical position and the ball bearings 48 between the two plates permit the face to expand freely during casting.

While the invention has been shown and described with respect to specific embodiments thereof, these are intended for the purpose of illustration rather than limitation and other modifications and variations will be apparent to those skilled in the art all within the intended spirit and scope of the invention. Accordingly, the patent is not to be limited to the specific embodiments herein shown and described nor in any other way that is inconsistent with the extend to which the progress in the art has been advanced by the invention.

I claim:

1. Apparatus for casting molten ferrous metal into slabs comprising:

a mold defining a slab casting cavity having a pouring end and a bottom end, means for moving said mold between a pouring position with said bottom end slightly higher than said pouring end and with said slab casting cavity at an angle of at least about 2° to the horizontal and an upright position with said pouring end at the top, said mold comprising two mold sections which define the faces of the slab to be cast, each section comprising a liner plate and a backing plate, said plates being parallel and spaced apart to define a spaced therebetween, means for securing said liner plate and said backing plate to one another in spaced apart relation which comprises a plurality of threaded stubs welded to the outer face of said liner plate and extending through corresponding openings in said backing plate, a plurality of metal balls interposed between said liner plate and said backing plate, a plurality of smaller metal balls interposed between said backing plate and a pressure plate on the opposite side of said backing plate, and threaded means cooperating with said stubs for securing said backing plate to said liner plate with said balls clamped therebetween, a sprue attached to said mold adjacent the pouring end of said casting cavity, and adapted to contain a reservoir of molten metal for feeding into said casting cavity when said mold is in both said pouring position and in said upright position, and means for cooling said mold.

2. Apparatus as defined in claim 1 wherein said liner plate is provided with a matrix of slots on the outer surface thereof, said slots extending in depth about ¾ the thickness of said liner plate to prevent warping of said liner plate due to thermal stresses occurring during the casting operation.

3. Apparatus as defined in claim 2 wherein said liner plate has a thickness of about 4 inches and said slots have a depth of about 3 inches.

4. Apparatus as defined in claim 2 wherein said slots include one group extending lengthwise of said liner plate and another group extending widthwise of said liner plate, said groups intersecting at right angles.

5. Apparatus as defined in claim 4 wherein said slot of each of said groups are spaced apart six inches whereby said slots define a matrix of 6-inch squares.

6. Apparatus as defined in claim 2 wherein said slots have a width of from 1/16 inch to ¼ inch.

7. Apparatus as defined in claim 2 including means located between said liner plate and said backing plate for spraying cooling water on said liner plate during the casting process.

8. Apparatus for casting molten metal into slabs comprising:

a mold defining a slab casting cavity having a pouring end and a bottom end, means for moving said mold between a pouring position with said bottom end slightly higher than said pouring end and with said slab casting cavity at an angle of about 3° to the horizontal and an upright position with said pouring end at the top, a sprue attached to said mold adjacent the pouring end of said casting cavity, and adapted to contain a reservoir of molten metal for feeding into said casting cavity when said mold is in both said pouring position and in said upright position, means operable when said mold is in its upright position for advancing said sprue into said casting cavity to keep the forward end of said sprue contiguous with the upper end of the slab during shrinkage thereof as said mold solidifies, and a shrinkage sensing means adapted to have a portion thereof embedded in the upper end of the slab and to move downward in correspondence to shrinkage of said slab, control means operatively connected to said sensing means and motive means adapted to be energized by said control means for moving said sprue forwardly relative to said mold.

9. Apparatus as defined in claim 8 wherein said skrinkage sensing means comprises a metal rod slidably extending through the upper end of said mold.

* * * * *